US006527542B1

(12) United States Patent
Chen

(10) Patent No.: US 6,527,542 B1
(45) Date of Patent: Mar. 4, 2003

(54) CHILD-PROOF SAFETY DEVICE FOR ECLIPSE LIGHTER

(76) Inventor: Peter Chen, 11135 E. Rush St., Unit B, South El Monte, CA (US) 91733

( * ) Notice: Subject to any disclaimer, the term of this patent is extended or adjusted under 35 U.S.C. 154(b) by 0 days.

(21) Appl. No.: 09/699,315

(22) Filed: Oct. 30, 2000

(51) Int. Cl.[7] ..... F23D 11/36; F23Q 2/28
(52) U.S. Cl. ..... 431/153; 431/255; 431/256
(58) Field of Search ..... 431/153, 255, 431/254, 144, 152, 151, 256

(56) References Cited

U.S. PATENT DOCUMENTS

| | | | | | |
|---|---|---|---|---|---|
| 4,850,854 | A | * | 7/1989 | Buck | 431/144 |
| 4,904,180 | A | * | 2/1990 | Nitta | 431/153 |
| 5,055,034 | A | * | 10/1991 | Wang | 431/255 |
| 5,308,240 | A | * | 5/1994 | Lowenthal | 431/255 |
| 5,662,466 | A | * | 9/1997 | Cheng | 431/153 |
| 5,829,963 | A | * | 11/1998 | Ichikawa | 431/153 |
| 5,885,069 | A | * | 3/1999 | Rogelet | 431/153 |
| 5,971,751 | A | * | 10/1999 | Lee | 431/255 |

FOREIGN PATENT DOCUMENTS

| | | | | | |
|---|---|---|---|---|---|
| GB | 1 404 381 | A | * | 8/1975 | 431/255 |
| GB | 1 435 657 | A | * | 5/1976 | 431/255 |
| JP | 11-6620 | A | * | 1/1999 | 431/153 |

* cited by examiner

*Primary Examiner*—Henry Bennett
*Assistant Examiner*—Josiah C. Cocks
(74) *Attorney, Agent, or Firm*—Raymond Y. Chan; David & Raymond Patent Group

(57) ABSTRACT

A child-proof safety device for eclipse lighter includes a deformable resistance member placed between a piezoelectric generator and a supporting bar providing an press resistance to the thumb-pusher, wherein the deformable resistance member has two grooves formed on two sides thereof corresponding to the end of a U-shaped metal-piece gas lever. The press resistance will resist a downwardly pressing force applied by an under age child on the thumb-pusher while an adult is capable of pressing the thumb-pusher easily.

2 Claims, 4 Drawing Sheets

CHILD-PROOF SAFETY DEVICE FOR ECLIPSE LIGHTER

BACKGROUND OF THE PRESENT INVENTION

1. Field of Invention

The present invention relates to a child-proof safety device for eclipse lighter and more particularly to child-proof safely device for preventing under age children from the usage of cigarette lighter by the limitation of their physical capability that highly decrease the rate of accident cause by accidental fire or burn on one's body.

2. Description of Related Arts

Most fires are caused accidentally by ignorance of human mistakes, especially among our children. We tried to teach our young ones to not step into the accident mistake of starting an accidental fire, but it is very difficult to enforce adult supervision over them all the time. In most accidental fire cases today, many were started by the ignorant usage of cigarette lighters, especially when someone in the family who is a smoker which having many cigarette lighters laying around the house waiting for the young one to pick it up and use it.

In the resent years, there are many safety lighters manufactured throughout the market. The safety means people cannot directly ignite a lighter. Usually, a lock is added into the lighter to ensure there is no accidental fuel leaking or ignorance of usage of lighter.

Conventional safety lock lighter comprises a safety lock that prevents the lighters' nozzle accidentally be depressed thereby causing an unintended election. Operating the safety lock lighter, user must unlock the safety lock first in order to ignite the lighter by pressing a button or switching the lock aside. Such feature related to mechanism is designed to prevent ignition of a fuel source unless the lighter is properly oriented. However, this incorporating feature of the safety lock is difficult to use by certain users. It is inconvenient that users may repeat the step of unlock the safety lock many times until they ignite the lighter in certain conditions.

Moreover, lighters having the safety lock feature cannot stop children from igniting it after a period of time. Usually, the safety switch are hidden or placed at the side of the lighter. In most cases through a period of time, kids seem to be able to figure out to put these safety lighters into use without any complication. So, the existing safety lighters do not really safe enough to prevent under age children from the usage of lighters. However, other safety strategy can be applied on the lighter that the strategy is to limit the kids' physical capability.

SUMMARY OF THE PRESENT INVENTION

The main object of the present invention is to provide a child-proof safety device for eclipse lighter for preventing under age children from the usage of lighters.

Another object of the present invention is to provide a child-proof safety device for eclipse lighter which can stop under age children from the usage of lighters by the limitation of their physical capability.

The present invention is to provides a child-proof safety device for eclipse lighter which comprises a casing having a liquefied gas cavity defined therein; a gas ejecting tip appearing from a ceiling of the casing and communicating with the liquefied gas cavity; a cap covered the as ejection tip being jointed at the side of the casing and adjusting to pop open outwardly; a piezoelectric generator which is fitted in the casing having an igniting tip connected thereto; and a thumb-pusher, which is attached to a top end of the piezoelectric generator, exposing a top portion thereof above the casing: an U-shaped metal-piece gas lever, which is connected between the valve on the gas tube extended downwardly from the gas ejecting tip and the lowest end of the thumb-pusher. surrounding the supporting bar connected under the ceiling. The child-proof safety device comprises a deformable resistance member placed between the piezoelectric generator and the supporting bar providing an additional press resistance to the thumb-pusher; two grooves on the sides of the deformable resistance member corresponding to the ends of the U-shaped metal-piece gas lever. Therefore, when pushing the thumb-pusher, the lower portion of the thumb-pusher will press the end of the U-shaped metal-piece gas lever corresponded to the grooves on the deformable resistance member downwardly. This mechanism provides an indirect additional press resistance to the thumb-pusher from the deformable resistance member. The additional press resistance will resist a downwardly pressing force applied by an under age child on the thumb-pusher while an adult is capable of pressing the thumb-pusher easily.

DETAILED DESCRIPTION OF THE PREFERRED EMBODIMENT

Figure 1:
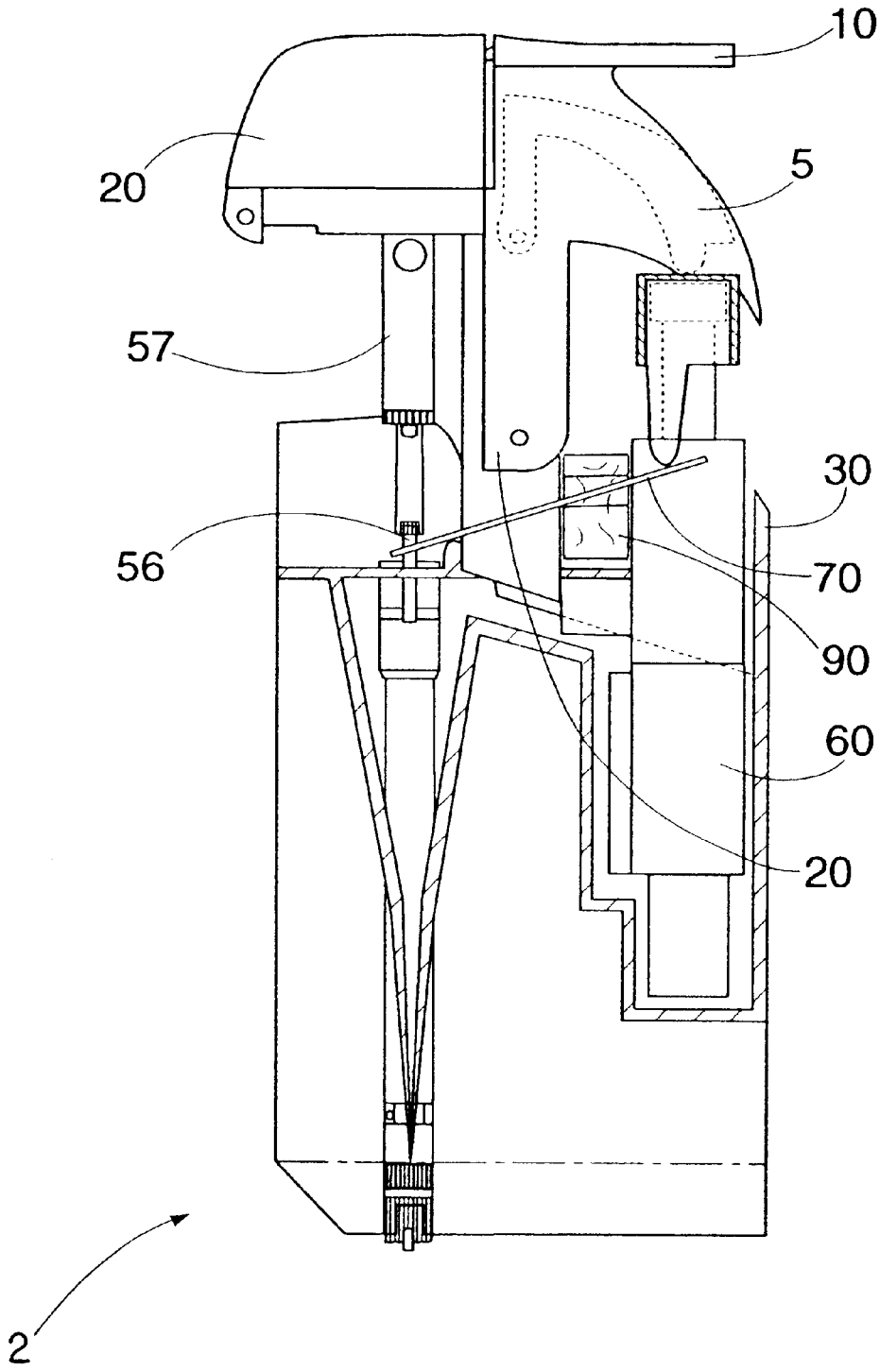
FIG. 1 is a perspective view of a child-proof safety device for eclipse lighter of a preferred embodiment according to the present invention.
Figure 2:
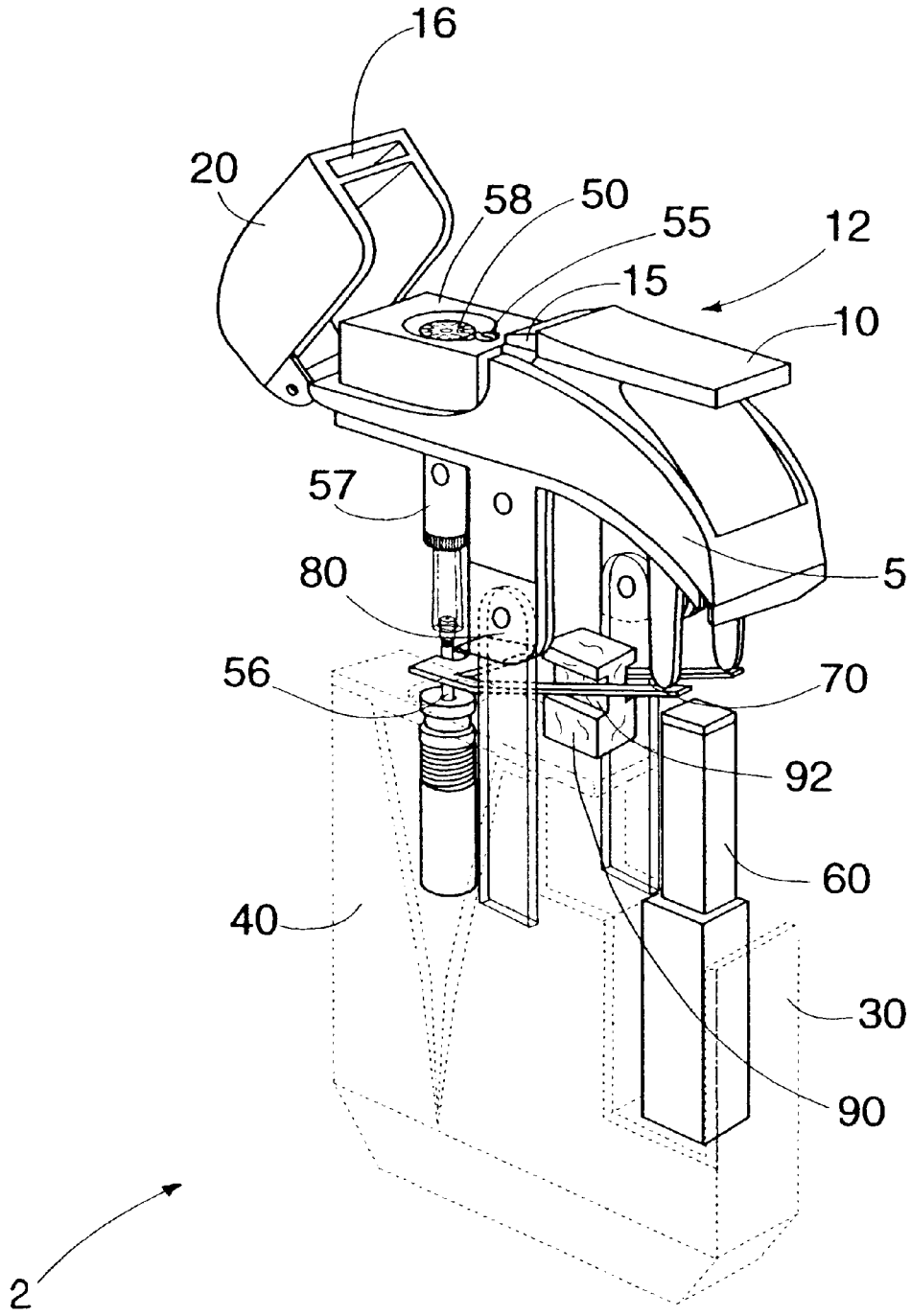
FIG. 2 is another perspective view of a child-proof safety device of the above preferred embodiment according to the present invention.

Referring to FIGS. 1 and 2, an eclipse lighter 2 is illustrated, which comprises a casing 30 having a liquefied gas cavity 40 defined therein; a gas ejecting tip 50 appearing from a ceiling 5 of the casing 30 and communicating with the liquefied gas cavity 40; a cap 20 covered the as ejection tip 50 being jointed at the side of the cashes 30 and adjusting to pop open outwardly; a windshield 58 mounted on the ceiling 5 of the casing 30 and encircling the gas ejection tip; a piezoelectric generator 60 which is fitted in the casing 30 having an igniting tip 55 connected thereto; and a thumb-pusher 10, which is attached to a top end of the piezoelectric generator 60, exposing a top portion thereof above the cashing 30; an U-shaped metal-piece gas level 70, which is connected between the valve 56 on the gas tube 57 extended downwardly from the gas ejecting, tip 50 and the lowest end of the thumb-pusher 10, surrounding the supporting bar 80 connected under the ceiling 5.

The thumb-pusher 10 is operatively connected both to the gas ejecting tip 50 and to the piezoelectric generator 60 for striking spark in response to a press to the thumb-pusher 10. While the thumb-pusher 10 is forced to drive downwardly, the piezoelectric generator 60 will be compressed and generated a spark. At the mean time, the end of the U-shaped metal-piece gas lever 70 connected to the lower portion of the thumb-pusher 10 will also be driven downwardly. The U-shaped metal-piece gas lever 70 will act like a seesaw that is when the one end is up, the other end will go down. So, the other end of the U-shaped metal-piece gas level 70 connected to the valve 56 will drive upwardly in order to open the valve 56. As a spark is generted and out to the igniting tip 55 towards the gas ejection tip 50, the gas fuel will be released from the open valve 56. The ejecting gas will be ignited by the striking spark ejected from the gas ejection tip 50.

Referring to FIG. 2, a lock 12 comprises a protruding unit 15 located at the front of the thumb-pusher 10 and a cavity 16 located at the front of the cap 20. When closing the cap 20 the protruding unit 15 will fit into the cavity 16 and hold the cap on the ceiling 5 covering the gas ejection tip 50. The cap 20 will pop open outwardly when pressing the thumb-pusher 10 as the protruding unit 15 at the front of the thumb-pusher 10 separated from the cavity 16 on the front of the cap 20.

Figure 3:
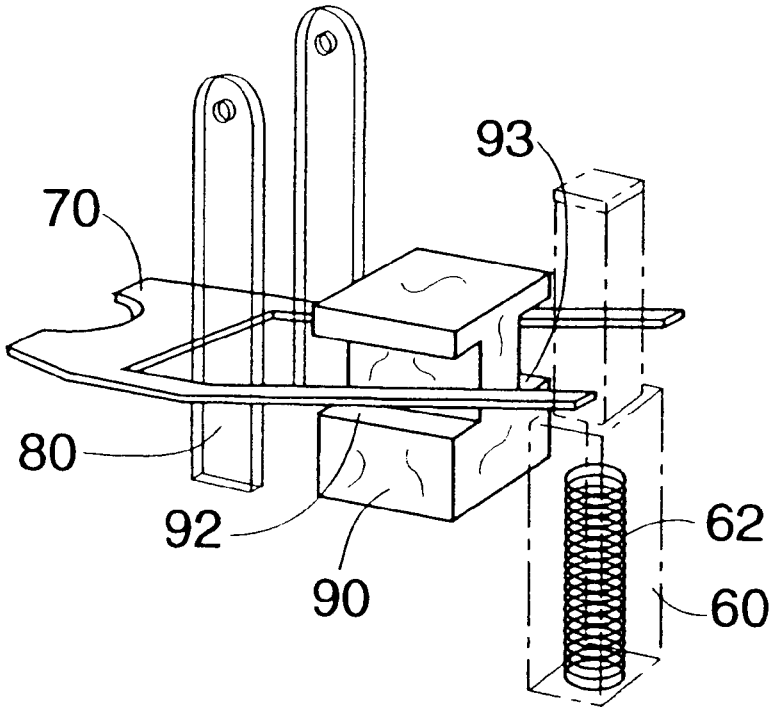
FIG. 3 is an exploded view of a child-proof safety device of the above preferred embodiment according to the present invention, illustrating the arrangement between the U-shaped metal-piece gas lever, the supporting bar, the deformable resistance member, and the piezoelectric generator.

In accordance with a preferred embodiment of the present invention, the child-proof safety device comprises a deformable resistance member 90, such as a rubber post as shown in FIGS. 1 to 3, placed between the piezoelectric generator 60 and the supporting bar 80 providing an additional press resistance to the thumb-pusher 10; two grooves 92 and 93 on the sides of the deformable resistance member 90 corresponding to the end of the U-shaped metal-piece gas lever 70 (as shown in FIGS. 2 and 3). Having the end of the U-shaped metal-piece gas lever 70 through along the grooves 92 and 93 on the side of the deformable resistance member 90, the deformable resistance member 90 will affix at between the piezoelectric generator 60 and the supporting bar 80 without sliding out. The height of the grooves 92 and 93 is greater or equal to the travel displacement of the thumb-pusher 10 in order to ignite the lighter as well as the displacement of the end of the U-shaped metal-piece gas lever 70 which forced downwardly by the thumb-pusher 10.

Figure 4:
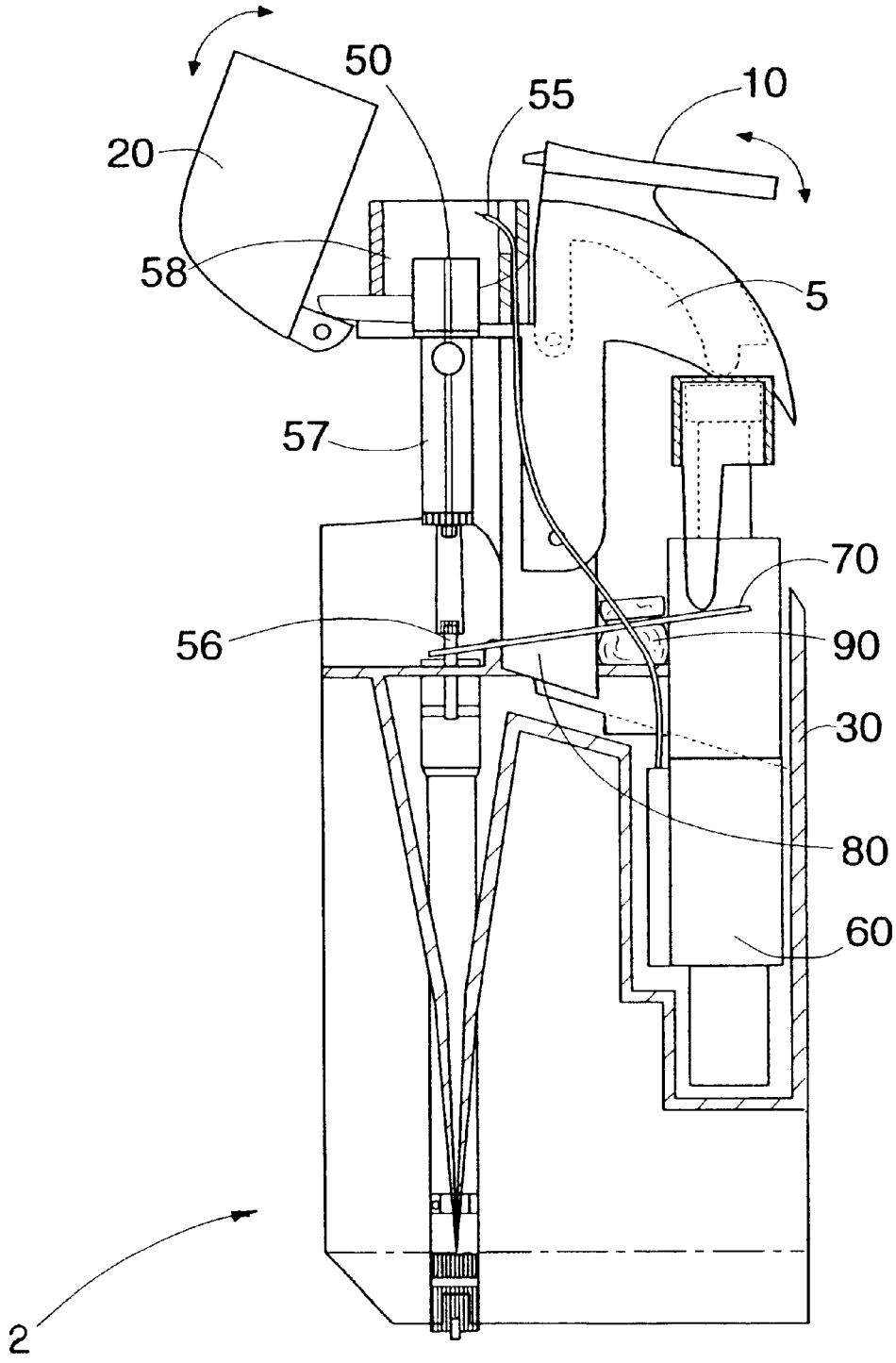
FIG. 4 is a perspective view of a child-proof safety device of the above preferred embodiment according to the present invention, illustrating the lighter is in igniting position.

When pushing the thumb-pusher 10, the lower portion of the thumb-pusher 10 will press the end of the U-shaped metal-piece gas lever 70 corresponded to the grooves on the deformable resistance member 90 downwardly. The deformable resistance member 90 is compressed to deform in an irregular shape due to the downward force indirectly applied by the user's thumb (as shown in FIG. 4). This mechanism provides an indirect additional press resistance to the thumb-pusher 10 from the deformable resistance member 90. This resistance effect will be provided to the under age children who do not have physical strength to compress the deformable resistance member 90. However, an adult will easy to press the thumb-pusher 10 in order to deform the deformable resistance member 90 for igniting purpose.

By releasing the thumb-pusher 10, the spring 62 inside the piezoelectric generator 60 will rebound and push the thumb-pusher 10 back to the original position. At the moment when releasing the thumb-pusher 10, the deformed deformable resistance member 90 will restore to its shape as well.

According to the preferred embodiment as disclosed above, the eclipse lighter of the present invention would stop under age children from the usage of the lighter by the limitation of their physical capability with out and substantial change to the configuration of the lighter. Simply placing the deformable resistance member 90 between the piezoelectric generator 60 and the supporting bar 80 will provide a safety feature for a lighter without any complicated lock. Users will operate the lighter in one continuous motion of pressing the thumb-pusher 10 without any previous step, for example, unlocks the safety lock. Moreover, the cost of the deformable resistance member 90 is inexpensive and the manufacturing procedure of the present invention is easy, so that the cost of the present invention is relatively inexpensive and will increase the competition in the lighter industry. easy, so that the cost of the present invention is relatively inexpensive and will increase the competition in the lighter industry.

What is claimed is:

1. An eclipse lighter, comprising:

a casing having a liquefied gas cavity provided therein and a supporting bar connected under a ceiling;

a gas ejecting tip appearing from said ceiling of said casing and communicating with said liquefied gas cavity via a valve;

a piezoelectric generator which is fitted in said casing having an igniting tip connected thereto and positioned adjacent to said gas ejection tip;

a thumb-pusher, which is attached to a top end of said piezoelectric generator, exposing a top portion thereof above said casing;

an U-shaped metal-piece gas lever connected between said valve and a lower portion of said thumb-pusher; and a child-proof safety device which comprises a deformable resistance member placed between said piezoelectric generator and said supporting bar to provide a press resistance to said U-shaped metal-piece gas lever so as to resist a downwardly pressing force applied from said thumb-pusher, wherein when pushing said thumb-pusher, said lower portion of said thumb-pusher presses an end of said U-shaped metal-piece gas lever downwardly, said deformable resistance member must be compressed to deform due to said downward pressing force indirectly applied thereto, wherein said press resistance resists said downwardly pressing force applied by an under age child on said thumb-pusher while an adult is capable of pressing said thumb-pusher to push said U-shaped metal-piece gas lever to compress said deformable resistance member to deform easily, wherein two grooves are respectively formed on two sides of said deformable resistance member corresponding to said end of said U-shaped metal-piece gas lever, wherein said deformable resistance material is affixed between said piezoelectric generator and said supporting bar with said end of said U-shaped metal-piece gas lever through along said grooves on said sides of said deformable resistance member, wherein and when pushing the thumb-pusher, said U-shaped metal-piece gas lever is pressed by said lower portion of said thumb-pusher corresponded to said grooves on said deformable resistance member downwardly so as to indirectly provide said press resistance to said thumb-pusher from said deformable resistance member.

2. The eclipse lighter, as recited in claim 1, wherein said deformable resistance material is made of rubber post.

* * * * *